US006496710B1

(12) United States Patent
Tsuzuki

(10) Patent No.: US 6,496,710 B1
(45) Date of Patent: Dec. 17, 2002

(54) SIGNAL FILTER HAVING CIRCULARLY ARRANGED RESONATORS

(75) Inventor: Genichi Tsuzuki, Nishikamo-gun (JP)

(73) Assignee: Cryodevice Inc., Nisshin (JP)

( * ) Notice: Subject to any disclaimer, the term of this patent is extended or adjusted under 35 U.S.C. 154(b) by 28 days.

(21) Appl. No.: 09/625,865

(22) Filed: Jul. 26, 2000

(30) Foreign Application Priority Data

Apr. 24, 2000 (JP) ..... 2000-122857

(51) Int. Cl.[7] ..... H01P 1/203; H01B 12/02
(52) U.S. Cl. ..... 505/210; 333/99.005; 333/204
(58) Field of Search ..... 333/995, 204; 505/210, 700, 701, 866

(56) References Cited

U.S. PATENT DOCUMENTS 6,130,189 A * 10/2000 Matthaei ..... 333/995 X
6,130,591 A * 10/2000 Tsuzuki ..... 333/995 X

OTHER PUBLICATIONS

Yoshiki Ueno et al., "High–temperature Superconducting Receiving Filter Subsystem for Mobile Telecommunication Base Station", IEICE Transactions on Electronics, vol. E82–C No. 7, Jul. 1999, pp. 1172–1176.

Balam Willemsen et al., "Microwave intermodulation in thin film high–Tc superconducting microstrip haripin resonators: Experiment and Theory." Appl. Phys. Lett. 71 (26) Dec. 1997, pp. 3898–3900.

G. Hampel et al., "High power failure of superconducting microwave filters: Investigation by means of thermal imaging" Appl. Phys. Lett. 69 (4), Jul. 1996, pp. 571–573.

George L. Matthaei et al., Novel Staggered Resonator Array Superconducting 2.3–GHz Bandpass Filter, IEEE Transactions On Microwave Theory and Techniques, vol. 41., No. 12., Dec. 1993, pp. 2345–2352.

* cited by examiner

*Primary Examiner*—Benny T. Lee
(74) *Attorney, Agent, or Firm*—Law Offices of David G. Posz

(57) ABSTRACT

A filter for filtering electrical signals comprises a substrate and a plurality of resonators formed circularly to surround the center of the substrate. Each resonator has an arcuate part at a radially outermost part and a pair of linear parts extending from ends of the arcuate part in a radially inward direction. The arcuate part is located at the same distance from the center of the substrate. The linear parts of each resonator have different lengths from each other thereby to provide a sharp decrease of gain at ends of the frequency passband in a filtering response.

16 Claims, 6 Drawing Sheets

SIGNAL FILTER HAVING CIRCULARLY ARRANGED RESONATORS

CROSS REFERENCE TO RELATED APPLICATION

This application relates to and incorporates herein by reference Japanese Patent Application No. 2000-122857 filed on Apr. 24, 2000.

BACKGROUND OF THE INVENTION

1. Field of the Invention

The present invention relates to a filter in which a plurality of resonators are formed circularly around the center of a substrate.

2. Related Art

In some conventional filters, resonators are formed in a hairpin pattern or forward-coupled pattern. The hairpin type is disclosed in, for instance, IEICE Transactions on Electronics, Vol. E82-C No. Jul. 7, 1999, "High-temperature Superconducting Receiving Filtering Subsystem for Mobile Telecommunication Base Station" of Appl. Phys. Lett. 71(26), Dec. 29, 1997, "Microwave intermodulation in thin film high-Tc superconducting microstrip hairpin resonators : Experiment and theory." The forward-coupled type is disclosed in, for instance, Appl. Phys. Lett. 69(4), Jul. 22, 1996, "High power failure of superconducting microwave filters: Investigation by means of thermal imaging."

The filters formed with the above resonator patterns require large substrates which extend in a lateral direction, when formed in multiple stages, or have only a limited number of stages in a fixed area. Further, it is difficult to regulate the coefficient or ratio of cross coupling which occurs between resonators other than the adjacent resonators in the above resonator patterns.

SUMMARY OF THE INVENTION

It is therefore an object of the present invention to provide a filter in which a plurality of resonators can be formed in a limited area of a substrate.

It is another object of the present invention to provide a filter in which the coefficient of coupling between resonators can be regulated with ease.

It is a further object of the present invention to provide a filter in which notches are provided at both edges of a passband for a sharp filtering or cut-off response.

According to the present invention, a filter for filtering electrical signals comprises a substrate and a plurality of resonators formed circularly on the substrate to surround the center of the substrate.

Each resonator has an arcuate part at a radially outermost part and a pair of linear parts extending from ends of the arcuate part in a radially inward direction and the arcuate part is located at the same distance from the center of the substrate. Thus, the number of the resonators provided in a limited area may be increased. Further, the linear parts of each resonator have different lengths from each other thereby to provide a sharp decrease of gain at edges of the passband in a filtering response.

BRIEF DESCRIPTION OF THE DRAWINGS

The above and other objects, features and advantages of the present invention will become more apparent from the following detailed description made with reference to the accompanying drawings. In the drawings.

DETAILED DESCRIPTION OF THE PREFERRED EMBODIMENT

Figure 1:
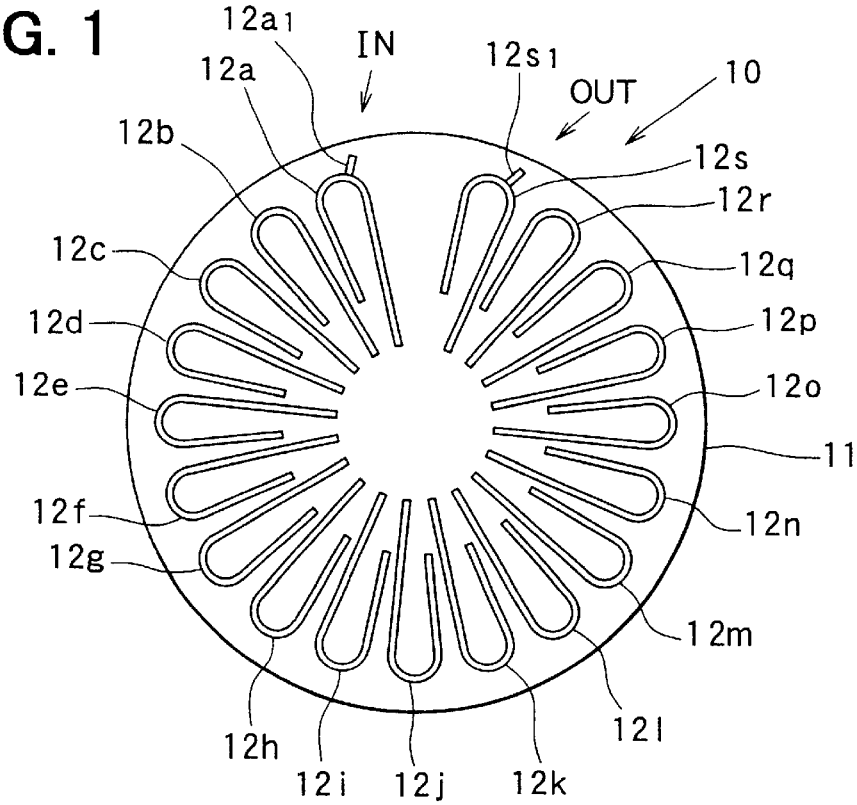
FIG. 1 is a plan view showing a filter according to an embodiment of the present invention.

Referring first to FIG. 1, a filter 10 has a distributed element microstrip structure. A plurality of resonators 12*a*, 12*b*, 12*c*, 12*d*, 12*e*, 12*f*, 12*g*, 12*h*, 12*i*, 12*j*, 12*k*, 12*l*, 12*m*, 12*n*, 12*o*, 12*p*, 12*q*, 12*r* and 12*s* are formed on top surface of a dielectric substrate 11 and a ground plane is formed on its bottom surface.

Each of the resonator 12*a* to 12*s* is bended like hairpin resonators and has a length which corresponds to a half of the wavelength (λ). Lead lines 12*a*1 and 12*s*1 are tap-connected to the resonators 12*a* and 12*s*, respectively. The leads 12*a*1 and 12*s*1 are used for receiving input signals (IN) to be filtered and producing filtered output signals (OUT), respectively.

The substrate 11 is shaped in a disk. The resonators 12*a* to 12*s* are arranged circularly to surround the center of the disk having a regular angular interval. Each of the resonator 12*a* to 12*s* is bent like hairpin resonators and has a length which corresponds to a half of the wavelength (λ). Lead lines 12*a*1 and 12*s*1 are tap-connected to the resonators 12*a* and 12*s*, respectively. The lead lines 12*a*1 and 12*s*1 are used for receiving input signals (IN) to be filtered and producing filtered output signals (OUT), respectively.

The resonators 12*a* to 12*s*, wires 12*a*1 and 12*s*1 and the ground plane are all formed with a film of superconducting material so that the filter 10 may be used as a superconducting-type filter.

Figure 2:
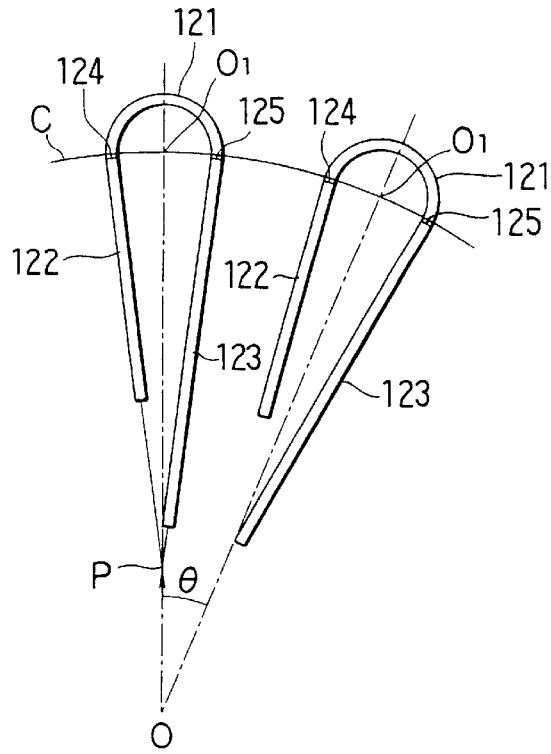
FIG. 2 is a schematic view showing two adjacent resonators of a plurality of resonators shown in FIG. 1.

As shown in FIG. 2 in detail, the resonators 12*a* to 12*s* have the same construction except that the resonators 12*a* and 12*s* have respective lead lines 12*a*1 and 12*s*1. Each resonator has an arcuate part 121 having ends 124 and 125, a first linear part 122 connected to the end 124, and a second linear part 123 connected to the end 125. The arcuate part 121 is located at the radially outermost part of the resonator. The first linear part 122 extends radially inward from the end 124 generally along the tangent of the arcuate part 121, and the second linear part 123 extends radially inward from the end 125 generally along the tangent of the arcuate part 123. The linear parts 122 and 123, however, are inclined from the tangents to cross each other, when extended further, at point P. Each center $O_1$ of the arcuate parts 121 are on a circle C having its center O. That is, the resonators 12*a* to 12*s* are arranged on the substrate 10 in such a manner that the center $O_1$ of each arcuate part 121 are on the circle C.

Figure 3:
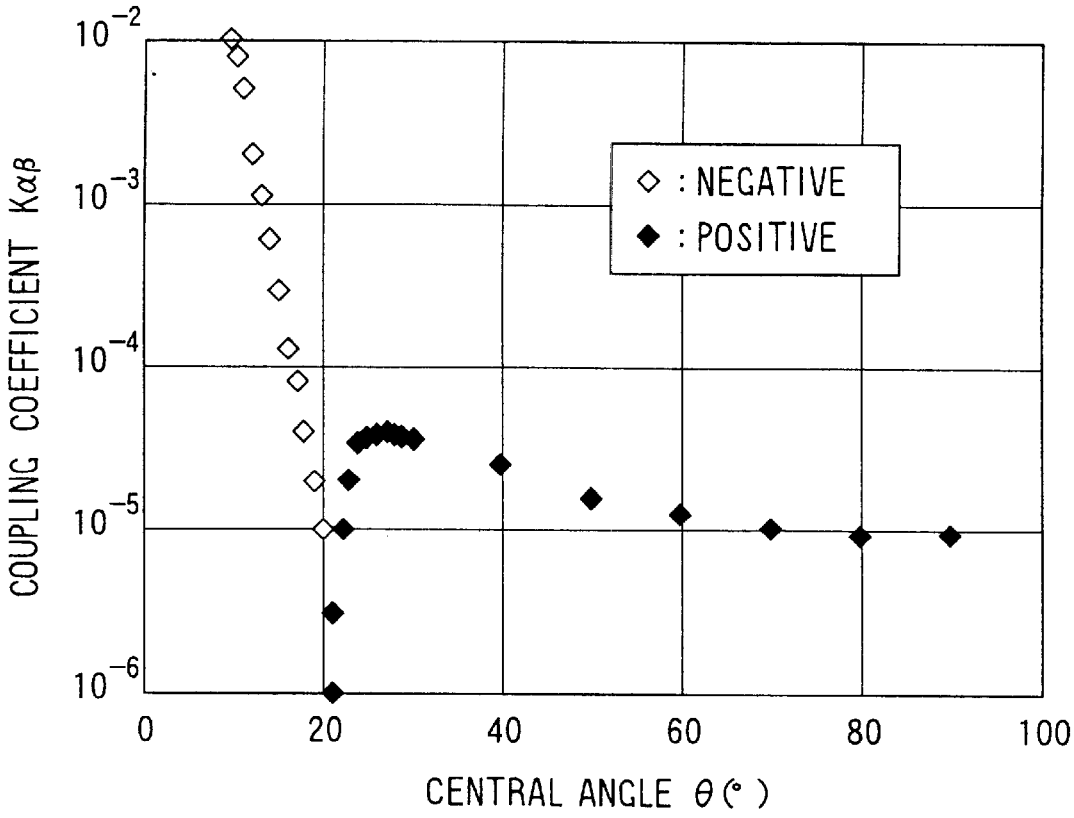
FIG. 3 is a graph showing results of a simulated relationship between a central angle and a coefficient of coupling between the resonators.

Two resonators, such as the exemplary resonators shown in FIG. 2, arranged adjacently are separated in the circumferential direction of the circle with a central angle θ between the centers $O_1$ of the arcuate parts 121. It is to be noted that the polarity of coupling between the adjacent two resonators can be reversed between negative coupling and positive coupling by changing the angle θ. The relationship between the central angle θ and the coupling coefficient $K_{\alpha\beta}$ is simulated and shown in FIG. 3. The simulation results are shown in FIG. 3.

Figure 4A:
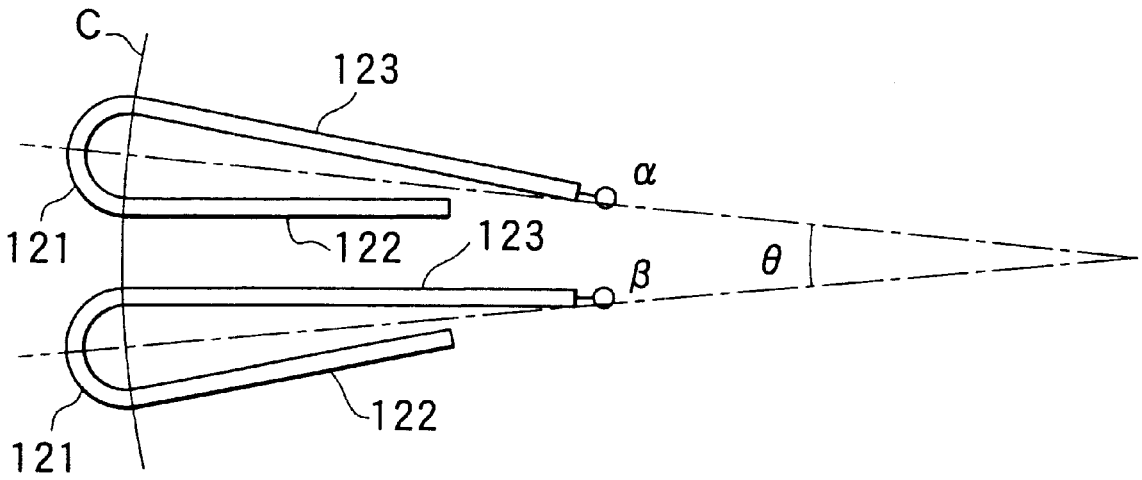
FIGS. 4A and 4B are a schematic view and an equivalent circuit diagram of the resonators used to calculate the coefficient of coupling.
Figure 4B:
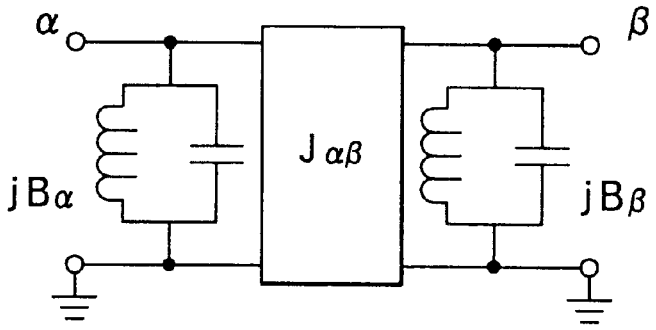

In this simulation, it is assumed that the ports of the resonators at the two linear parts 123 are defined as α and β as shown in FIG. 4A. The two resonators shown in FIG. 4A are represented in the electrical equivalent circuit as shown in FIG. 4B. The coupling coefficient $K_{\alpha\beta}$ between the two resonators is calculated as follows.

$$K_{\alpha\beta}=J_{\alpha\beta}/(B_\alpha \times B_\beta)^{1/2}$$

$$bi=(f/2)\times(dBi/df)|_{f=f0}(i=\alpha \text{ or } \beta)$$

In FIG. 4B, $jB_\alpha$ and $jB_\beta$ are susceptances of the resonators and equal the elements in the diagonal of the Y-matrix between the ports α and β, $b_i$ are respective resonator slope parameters and $B_i$ are respective resonator susceptibilities. Further, $J_{\alpha\beta}$ is the admittance inverter parameter and equals the absolute value of the elements in the off-diagonal of the Y-matrix between the ports α and β. The Y-matrix between the ports α and β can be calculated with an electromagnetic field simulator. The simulation using the above equivalent circuit is described in IEEE Trans. MTT Vol. 41, No 12, P. 2345, 1993.

It is thus understood from the simulation result shown in FIG. 3 that the coupling is made negative and positive with the central angle θ smaller and larger than 20°, respectively. In case that a number of resonators are arranged, each resonator is coupled with the adjacent resonators but also other resonators which are not adjacent. Thus, it becomes possible to regulate the ratio of cross coupling by appropriately setting the central angle between the resonators, so that the filter has a desired filtering response.

Specifically, the filtering response may be varied as shown in FIGS. 5A to 5E and FIGS. 6A to 6E. FIGS. 5A to 5E show various patterns of the resonator in which the ratio of length of the first and the second linear parts 122 and 123 are differentiated. FIGS. 6A to 6E show the results of simulation made on the patterns shown in FIGS. 5A to 5E, respectively, with respect to the relationship between the central angle θ and the coupling ratio $K_{\alpha\beta}$. In FIGS. 6A to 6E, the solid line and the dotted line show that the polarity of coupling is positive and negative, respectively.

Figure 5A:
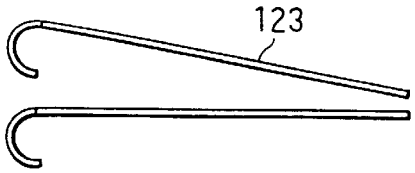
FIGS. 5A, 5B, 5C, 5D and 5E are schematic views showing different patterns of the resonators.
Figure 6A:
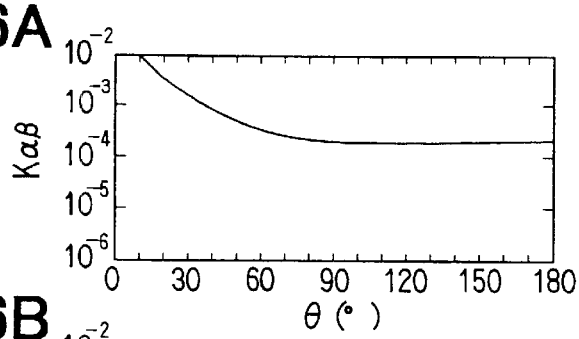
FIGS. 6A, 6B, 6C, 6D and 6E are graphs showing results of the simulated relationship between the central angle and the coefficient of coupling between the resonators in correspondence with the different patterns of the resonators shown in FIGS. 5A to 5E, respectively.
Figure 5B:
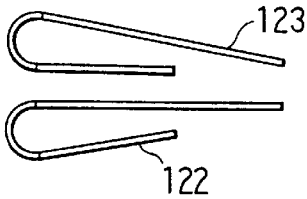
Figure 6B:
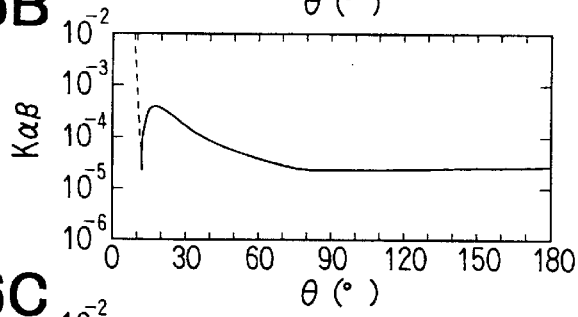
Figure 5C:
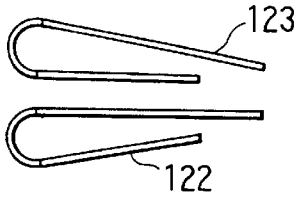
Figure 6C:
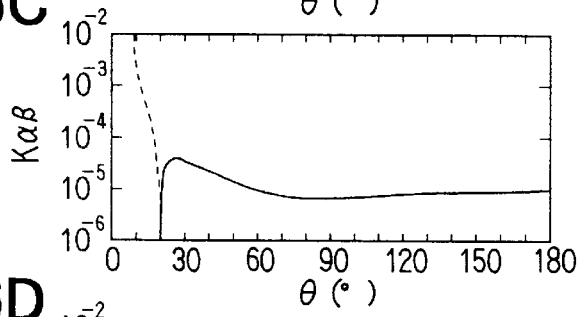
Figure 5D:
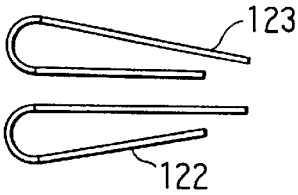
Figure 6D:
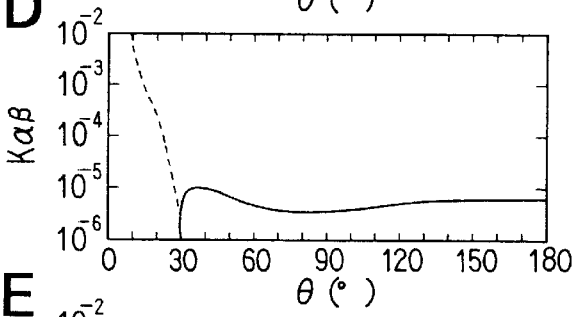
Figure 5E:
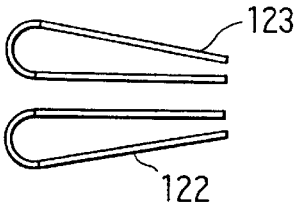
Figure 6E:
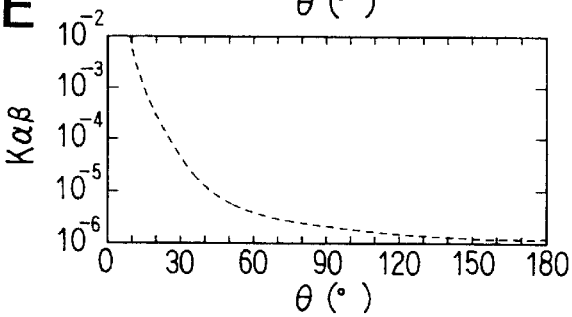

In case of the pattern which does not have the first linear part 122 as shown in FIG. 5A, the polarity of coupling is positive over any central angles θ as shown in FIG. 6A. In case of the patterns which have the first linear parts 122 of different lengths as shown in FIGS. 5B to 5D, the polarity of coupling reverses from negative to positive at different central angles θ as shown in FIGS. 6B to 6D, respectively. The central angle θ at which the polarity reverses increases as the ratio of the length of the first linear part 122 to that of the second linear part 123 increases. In case of the pattern which has the first and the second linear parts 122 and 123 of the same length as shown in FIG. 5E, the polarity of coupling is negative over any central angles θ as shown in FIGS. 6E. In any patterns, the coupling coefficient $K_{\alpha\beta}$ varies with the central angle θ but varies in different shape depending on the ratio between the lengths of the first and the second linear parts 122 and 123.

Figure 7A:
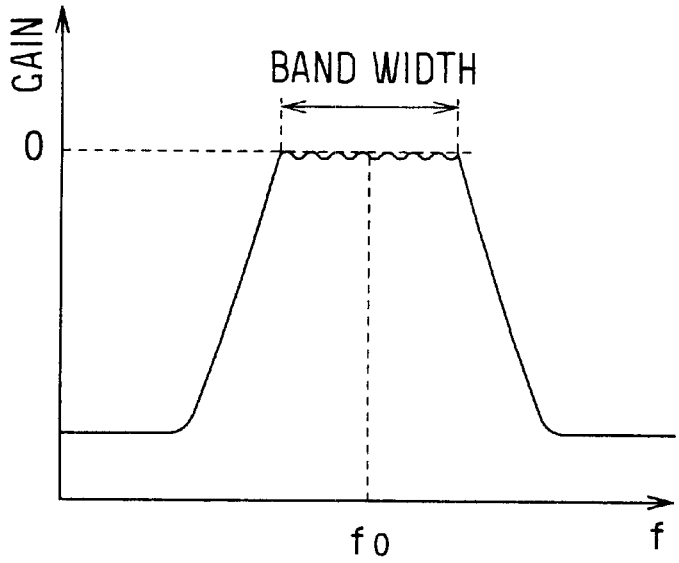
FIGS. 7A and 7B are graphs showing filtering (characteristics) of the filter.

The filtering response is determined based on the above simulation results. Specifically, the coupling coefficients $K_{\alpha\beta}$ between the two adjacent resonators are set based on the filtering response shown in FIG. 7A, that is, band width, the central frequency of and passband ripple. The central angle θ for each coupling coefficient $K_{\alpha\beta}$ set as above is determined for each pattern shown in FIGS. 5A to 5E with reference to the simulation results shown in FIGS. 6A to 6E.

For instance, if the coupling coefficient $K_{\alpha\beta}$ between the adjacent resonators is set to $10^{-3}$, it is derived that the polarity of coupling is positive and the central angle θ is about 37° from FIG. 6A in the case of pattern of FIG. 5A. Similarly, it is derived that the polarity of coupling is negative and the central angle θ is about 11° from FIG. 6B in the case of pattern of FIG. 5B. The polarity of coupling is negative and the central angle θ is about 14° from FIG. 6C in the case of pattern of FIG. 5C. The polarity of coupling is negative and the central angle θ is about 15° from FIG. 6D in the case of pattern of FIG. 5D. The polarity of coupling is negative and the central angle θ is about 16° from FIG. 6E in the case of pattern of FIG. 5E.

Figure 7B:
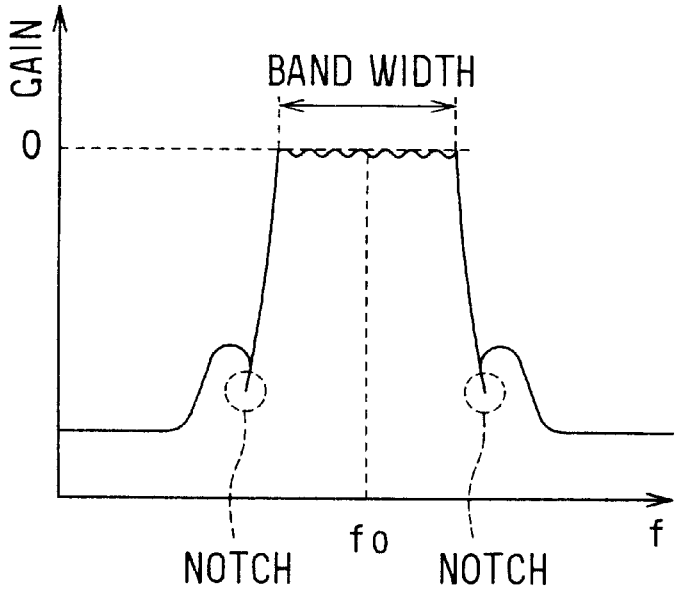

The cross coupling occurs through various paths between the resonators which are not adjacent each other. The polarity and the coefficient of each cross coupling are also derived from the simulation results shown in FIGS. 6A to 6E. This cross coupling provides notches at both ends of the bandwidth as shown in FIG. 7B, which is a graph of frequency f versus gain, thereby to sharpen further the filtering response of FIG. 7A, which is also a graph of frequency f versus gain. That is, the gain of the filter sharply decreases at both band edges to be lower than those at the frequencies higher and lower than the edges of the passband with center frequency $f_0$. The patterns shown in FIGS. 5B to 5D are advantageously used to provide the notches in the filtering response to realize the sharp response, because the polarity of coupling reverses to positive and negative as shown in FIGS. 6B to 6D.

As described above, the filter 10 is designed to be compact in size and to have a sharp filtering response by adjusting the ratio of length between the first and the second linear parts 122 and 123 and the central angle θ between the adjacent resonators.

Figure 8:
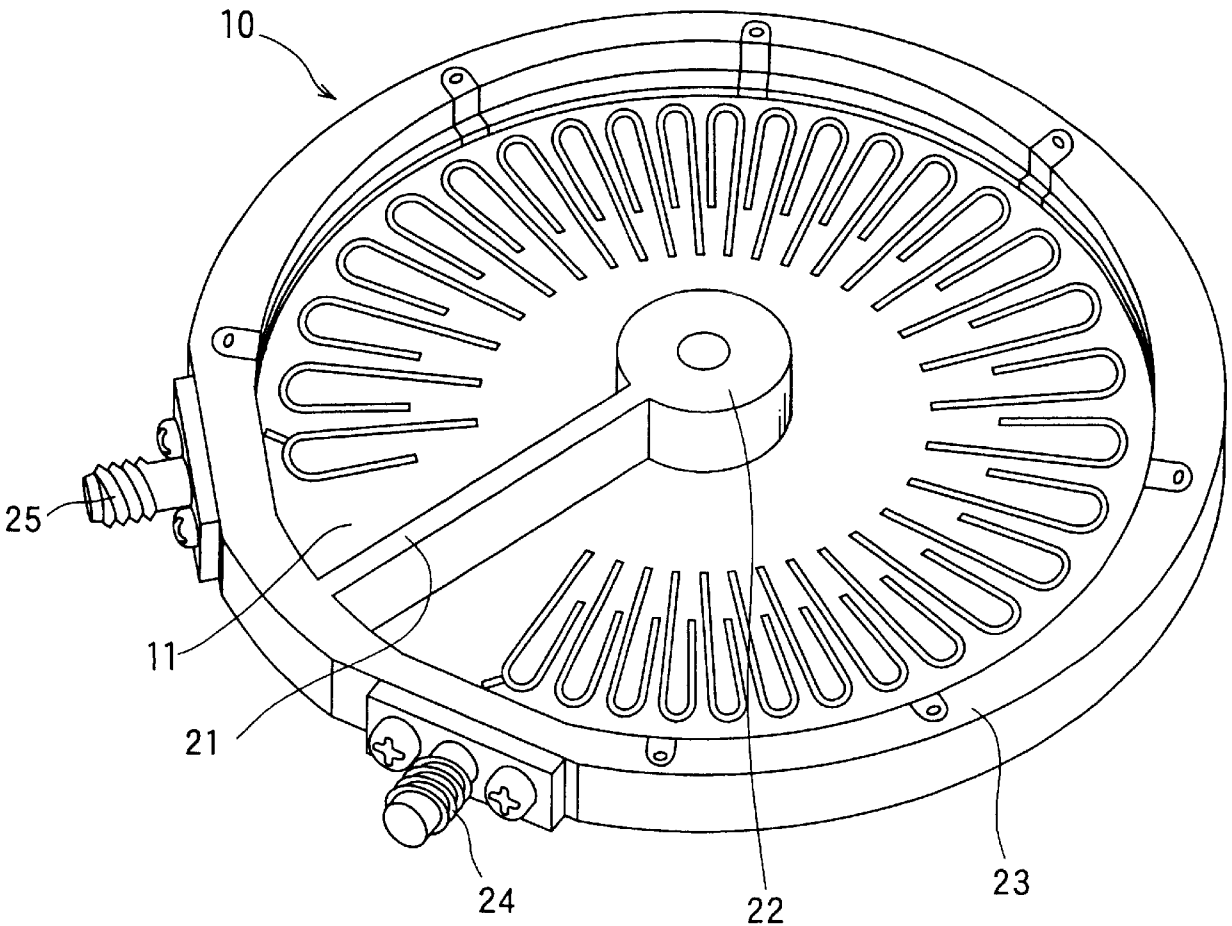
FIG. 8 is a perspective view of a practical model of the filter according to the embodiment of the present invention.

A practical model of the filter 10 which is for practical use is shown in FIG. 8. In this model, the filter 10 has thirty-two resonators arranged around the center of the disk-shaped substrate 11. A first shield body 21 is raised from the substrate 11 between the resonators, which are provided at the signal input side and the signal output side, thereby to restrict unnecessary coupling among the resonators. A second shield body 22 is raised from the substrate 11 at the central part of the substrate 11 to restrict the unnecessary coupling. The first and the second shield bodies 21 and 22 are made of an electrically conductive material integrally, and connected to a conductive casing 23. An input connector 24 and an output connector 25 are fixedly coupled to the casing 23.

According to the above embodiment, a plurality of resonators are arranged in the circumferential direction with the centers $O_1$ of the respective arcuate parts 121 being located on the circumference of the circle C as shown in FIG. 2. As a result, the number of resonators arranged on the given area of the substrate 11 can be increased. Further, the coupling coefficient between the resonators can be adjusted by not only the central angles θ between the resonators but also the ratio of length between a pair of linear parts 122 and 123 of each resonator. In addition, the notches can be provided at both edges of the passband in the filtering response by using reversal of the polarity of coupling, which occurs at certain central angle. Thus, the filtering response can be sharpened by these notches with ease.

The present invention should not be limited to the above embodiment, but may be implemented in many other ways. For instance, the first and the second linear parts 122 and 123 may be extended in parallel from the arcuate part 121 without being inclined to cross when extended. Although it is preferred that all the resonators are configured to have the arcuate part 121 and the linear parts 122 and 123 in the same conductive strip pattern, the resonators may be configured to have different patterns.

What is claimed is:

1. A filter comprising:

a substrate; and a plurality of resonators disposed on the substrate, wherein each of the plurality of resonators has an arcuate part, a first linear part connected to one end of the arcuate part, and a second linear part connected to another end of the arcuate part, and wherein a center of the arcuate part of each of the plurality of resonators is located an equal distance from a center of the substrate with respect to arcuate part centers of all others of the plurality of resonators; and wherein a coefficient of coupling between adjacent pairs of the plurality of resonators and a coefficient of coupling between non-adjacent pairs of the plurality of resonators are adjusted by a central angle defined between pairs of the plurality of resonators and a ratio between lengths of the first linear part and the second linear part.

2. A filter comprising:

a substrate; and a plurality of resonators disposed on the substrate, wherein each of the resonators has an arcuate part, a first linear part connected to one end of the arcuate part, and a second linear part connected to another end of the arcuate part, and wherein a center of the arcuate part of each of the resonators is located an equal distance from a center of the substrate with respect to arcuate part centers of all others of the plurality of resonators, and the first linear part and the second linear part of each of the resonators have different lengths.

3. The filter as in claim 2, wherein:

a central angle defined between adjacent pairs of the resonators and a ratio between lengths of the first linear part and the second linear part are determined based on a coefficient of coupling between the adjacent pairs of the resonators.

4. The filter as in claim 2, wherein:

a coefficient of coupling between adjacent pairs of the plurality of resonators and a coefficient of coupling between non-adjacent pairs of the plurality of resonators are adjusted by a central angle defined between pairs of the plurality of resonators and a ratio between lengths of the first linear part and the second linear part.

5. The filter as in claim 2, wherein:

a ratio between lengths of the first linear part and the second linear part are determined to provide a reversal of polarity in a coefficient of coupling between two of the plurality of resonators relative to changes in a central angle defined between the two of the plurality of resonators.

6. The filter as in claim 2, wherein:

the first linear part and the second linear part extend in generally tangential directions of the arcuate part from the one end and the another end, respectively.

7. The filter as in claim 2, wherein:

the first linear part and the second linear part extend in a tapering, radially inward direction from the arcuate part.

8. The filter as in claim 7, wherein:

the first linear part and the second linear part have different lengths to provide respective notches at passband edges in a filtering response.

9. The filter as in claim 8, wherein:

each of the plurality of resonators is configured in a same shape; and the first linear part and the second linear part are located radially inside the arcuate part.

10. The filter as in claim 9, further comprising:

a shield body provided on the substrate at a central part of the substrate and between adjacent pairs of the resonators which are at a signal input side and a signal output side.

11. A filter comprising:

a substrate; and a plurality of resonators disposed on the substrate, wherein each of the plurality of resonators has an arcuate part, a first linear part connected to one end of the arcuate part, and a second linear part connected to another end of the arcuate part, and wherein a center of the arcuate part of each of the plurality of resonators is located an equal distance from a center of the substrate with respect to arcuate part centers of all others of the plurality of resonators; and wherein a ratio between lengths of the first linear part and the second linear part are determined to provide a reversal of polarity in a coefficient of coupling between two of the plurality of resonators relative to changes in a central angle defined between the two of the plurality of resonators.

12. A filter comprising:

a substrate;

a plurality of resonators disposed on the substrate, wherein the plurality of resonators are configured to provide a sharp filtering response in which a gain is decreased at both band edges to be lower than the gain at frequencies higher and lower than edges of the passband;

wherein the plurality of resonators are arranged circularly on the substrate;

each of the plurality of resonators has a circumference part extending generally in a circumferential direction, a first linear part connected to one end of the circumference part and extending in a radial inward direction, and a second linear part connected to another end of the circumference part; and the first linear part and the second linear part have different lengths.

13. The filter as in claim 12, wherein:

the first linear part and the second linear part are tapered inwardly toward each other and limited in length so as to not cross each other near a center of the substrate.

14. The filter as in claim 13, wherein:

each of the plurality of resonators has a same shape.

15. The filter as in claim 14, wherein:

the circumference part is in an arcuate shape and has a center on a circumference of a circle around the center of the substrate.

16. A filter comprising:

a substrate; and a plurality of resonators disposed on the substrate, wherein each of the plurality of resonators has an arcuate part, a first linear part connected to one end of the arcuate part, and a second linear part connected to another end of the arcuate part, and wherein a center of the arcuate part of each of the plurality of resonators is located an equal distance from a center of the substrate with respect to arcuate part centers of all others of the plurality of resonators, and the first linear part and the second linear part of each of the plurality of resonators extend radially inwardly toward each other and have different lengths to provide respective notches at passband edges in a frequency response of the filter.

* * * * *